US009395649B1

(12) United States Patent
Kanno et al.

(10) Patent No.: US 9,395,649 B1
(45) Date of Patent: Jul. 19, 2016

(54) IMAGE FORMING APPARATUS AND DEVELOPER CONTAINER

(71) Applicant: FUJI XEROX CO., LTD., Tokyo (JP)

(72) Inventors: Makoto Kanno, Kanagawa (JP); Kiyohito Horii, Kanagawa (JP); Shinichiro Fujimori, Kanagawa (JP); Seigo Shinozaki, Kanagawa (JP); Shota Oba, Kanagawa (JP); Norihiro Tamazawa, Kanagawa (JP); Ayumi Noguchi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/801,205

(22) Filed: Jul. 16, 2015

(30) Foreign Application Priority Data

Mar. 6, 2015 (JP) ..... 2015-045094

(51) Int. Cl.
*G03G 15/08* (2006.01)

(52) U.S. Cl.
CPC ..... *G03G 15/0877* (2013.01); *G03G 15/0865* (2013.01)

(58) Field of Classification Search
CPC ..... G03G 15/0855; G03G 15/0865; G03G 15/0882; G03G 15/0875; G03G 15/0886; G03G 15/0877; G03G 21/1633; G03G 21/1647; G03G 21/1821; G03G 21/1832; G03G 21/185; G03G 2215/0141
See application file for complete search history.

(56) References Cited

U.S. PATENT DOCUMENTS

2007/0147900 A1* 6/2007 Taguchi ..... G03G 15/0855 399/258

FOREIGN PATENT DOCUMENTS

JP 2001-222158 A 8/2001

* cited by examiner

*Primary Examiner* — Roy Y Yi
(74) *Attorney, Agent, or Firm* — Sughrue Mion, PLLC

(57) ABSTRACT

An image forming apparatus includes: a developer container having a containing portion which contains developer and is rotated when a driving force is transmitted to the containing portion from an image forming apparatus body, a discharge portion that rotatably supports the containing portion and has a discharge port through which the developer is discharged, and a restricting member provided at the discharge portion and movable between a restricting position where the restricting member restricts rotation of the containing portion and a releasing position where the restricting member releases the restriction of rotation of the containing portion, the developer container being removably attached to the image forming apparatus body; and a releasing member that is supported on the image forming apparatus body and moves the restricting member to the releasing position when the developer container is attached to the image forming apparatus body.

11 Claims, 10 Drawing Sheets

IMAGE FORMING APPARATUS AND DEVELOPER CONTAINER

CROSS-REFERENCE TO RELATED APPLICATIONS

This application is based on and claims priority under 35 USC 119 from Japanese Patent Application No. 2015-045094 filed Mar. 6, 2015.

BACKGROUND

Technical Field

The present invention relates to an image forming apparatus and a developer container.

SUMMARY

According to an aspect of the invention, there is provided an image forming apparatus including: a developer container having a containing portion which contains developer and is rotated when a driving force is transmitted to the containing portion from an image forming apparatus body, a discharge portion that rotatably supports the containing portion and has a discharge port through which the developer is discharged, and a restricting member provided at the discharge portion and movable between a restricting position where the restricting member restricts rotation of the containing portion and a releasing position where the restricting member releases the restriction of rotation of the containing portion, the developer container being removably attached to the image forming apparatus body; and a releasing member that is supported on the image forming apparatus body and moves the restricting member to the releasing position when the developer container is attached to the image forming apparatus body.

BRIEF DESCRIPTION OF THE DRAWINGS

Exemplary embodiments of the present invention will be described in detail based on the following figures, wherein.

DETAILED DESCRIPTION

Figure 1:
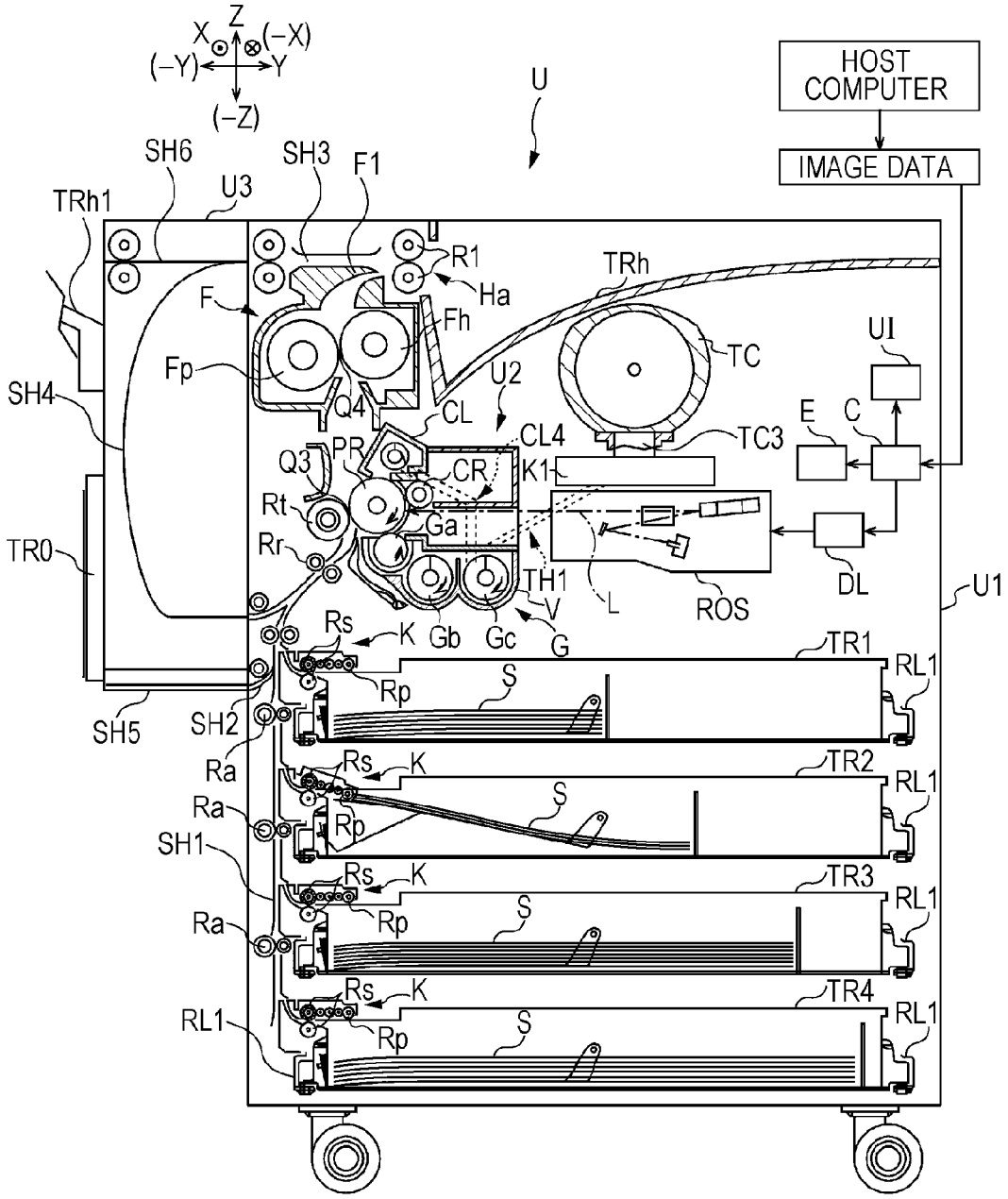
FIG. 1 shows the overall configuration of an image forming apparatus according to a first exemplary embodiment.

Exemplary embodiments of the present invention will be described below with reference to the drawings. Note that the present invention is not limited to the exemplary embodiments described below.

For ease of understanding, in the drawings, the front-rear, left-right, and top-bottom directions are denoted by the X-axis, Y-axis, and Z-axis directions, respectively, and the directions indicated by the arrows X, −X, Y, −Y, Z, and −Z correspond to the front, rear, right, left, top, and bottom, respectively.

Furthermore, a symbol including a circle (○) and a dot (●) in the circle represents an arrow directed from the back to the front of a sheet, and a symbol including a circle (○) and a cross (x) in the circle represents an arrow directed from the front to the back of a sheet.

For ease of understanding, components that are unnecessary for explanation are not illustrated in the drawings.

First Exemplary Embodiment

FIG. 1 shows the overall configuration of an image forming apparatus according to a first exemplary embodiment.

Referring to FIG. 1, a printer U, serving as an example of an image forming apparatus according to a first exemplary embodiment, includes a printer body U1, serving as an example of an apparatus body. The printer body U1 has a first output tray TRh, serving as an example of a first medium-output portion, in the top surface thereof. The printer body U1 has an operating portion UI on the right top surface thereof. The operating portion UI has a display (not shown), etc., and allows a user to enter commands.

A host computer, more specifically, a personal computer, serving as an image-information transmitting unit, is electrically connected to the printer U according to the first exemplary embodiment.

The printer U includes a controller C, serving as an example of a control unit. The controller C receives image information and an electric signal, such as a control signal, sent from the personal computer PC. The controller C sends a control signal to the operating portion UI and an electric circuit E. The controller C is electrically connected to a writing circuit DL.

The writing circuit DL outputs a driving signal to an exposure unit ROS, serving as an example of a writing unit, according to information input thereto. The exposure unit ROS emits laser light L, serving as an example of writing light, according to the driving signal.

Figure 2:
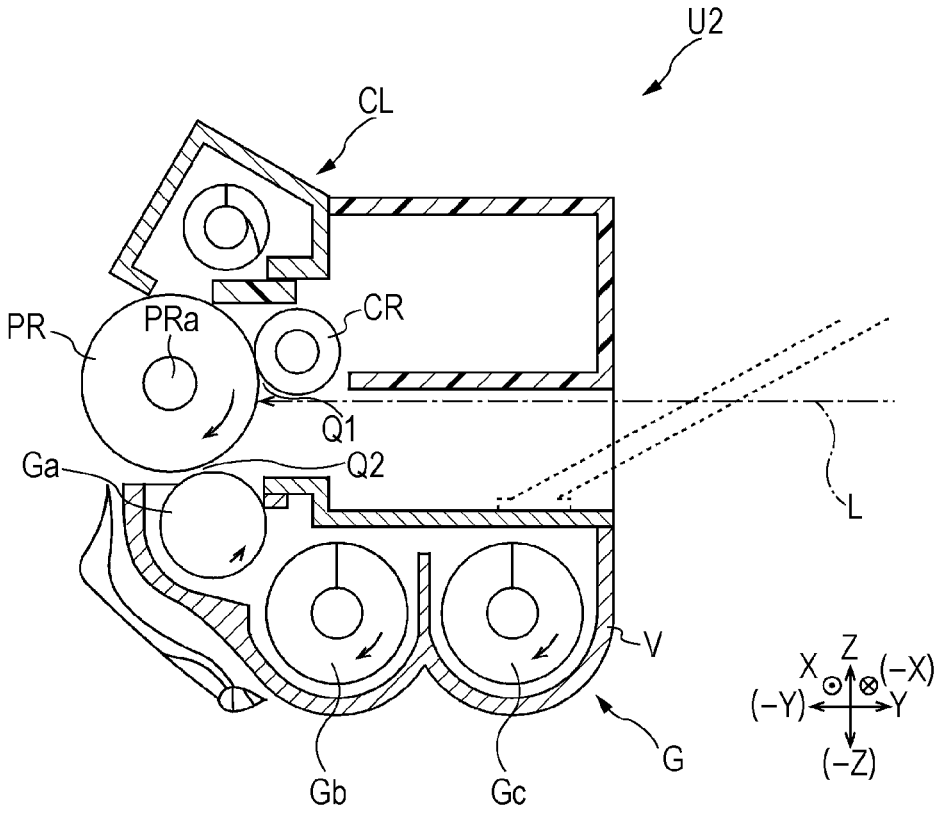
FIG. 2 is an enlarged view of the relevant part of a toner-image forming unit shown in FIG. 1.

FIG. 2 is an enlarged view of the relevant part of a toner-image forming unit shown in FIG. 1.

Referring to FIGS. 1 and 2, a photosensitive member PR, serving as an example of an image carrier, is provided to the left of the exposure unit ROS. The photosensitive member PR according to the first exemplary embodiment is supported so as to be rotatable about a pivot shaft PRa in the direction indicated by the arrow. The photosensitive member PR is irradiated with the laser light L in a writing area Q1.

A charging roller CR, serving as an example of a charging member; a developing device G; and a photosensitive member cleaner CL, serving as an example of an image carrier cleaner, are provided around the photosensitive member PR, in this order in the rotation direction of the photosensitive member PR.

In the printer U according to the first exemplary embodiment, the photosensitive member PR, the charging roller CR, the developing device G, and the photosensitive member cleaner CL form a unit that is integrally attached and removed. That is, the photosensitive member PR, the charging roller CR, the developing device G, and the photosensitive member cleaner CL form a process unit U2 that is attachable to and removable from the printer body U1.

The charging roller CR receives a charging voltage from the electric circuit E.

The developing device G has a developer container V that contains toner, serving as an example of developer. In the developer container V, a developing roller Ga that serves as an example of a developer carrier is rotatably supported. The developing roller Ga is opposed to the photosensitive member PR in a developing area Q2.

Furthermore, the developing roller Ga receives a developing voltage from the power supply circuit E. Augers Gb and Gc, serving as an example of a developer transport member, are rotatably supported in the developer container V.

The photosensitive member PR, the charging roller CR, the exposure unit ROS, and the developing device G form a toner-image forming unit that forms a toner image on the photosensitive member PR.

One end of a supply path of a toner supply unit TH1, serving as an example of a developer supply unit and supported in a fixed manner by the printer U, is connected to the developer container V. The other end of the supply path of the toner supply unit TH1 is connected to a toner cartridge TC, serving as an example of a developer container.

The toner cartridge TC is removably attached to the printer U by being inserted or extracted in the front-rear direction.

Referring to FIG. 1, paper feed trays TR1 to TR4, serving as an example of a medium containing portion, are provided at the lower part of the printer U. The paper feed trays TR1 to TR4 accommodate recording sheets S, serving as an example of a medium.

Rails RL1, serving as an example of a containing-portion guide member, are provided to the right and left of each of the paper feed trays TR1 to TR4. The rails RL1 slidably support the right and left ends of the paper feed trays TR1 to TR4. That is, the paper feed trays TR1 to TR4 are each supported by the pair of right and left rails RL1 so as to be slidable in the front-rear direction.

Paper feed units K are provided to the upper left of the paper feed trays TR1 to TR4. Each paper feed unit K includes a pick-up roller Rp, serving as an example of a medium pick-up member. To the left of the pick-up roller Rp is separating rollers Rs, serving as an example of a separating member. The separating rollers Rs include a feed roller, serving as an example of a medium transport member, and a retard roller, serving as an example of a medium separating member.

A paper feed path SH1, serving as an example of a medium transport path, is provided to the left of the paper feed units K. The paper feed path SH1 extends upward. Multiple transport rollers Ra, serving as an example of a medium transport member, are provided along the paper feed path SH1. Registration rollers Rr, serving as an example of a medium-transportation-timing adjusting member, are provided at the upper end, i.e., downstream end, of the paper feed path SH1.

A manual feed tray TR0, serving as an example of a manual feed portion, is provided on the left side of the printer U. A left end of a manual feed path SH2, serving as an example of a manual-feed transport path, is connected to the right side of the manual feed tray TR0, and a right end of the manual feed path SH2 is connected to the paper feed path SH1.

Referring to FIG. 1, a transfer roller Rt, serving as an example of a transfer device, is provided above the registration rollers Rr. The transfer roller Rt is opposed to and in contact with the photosensitive member PR in a transfer area Q3. Thus, the transfer roller Rt according to the first exemplary embodiment is rotated by the rotation of the photosensitive member PR. The transfer roller Rt receives supply of a transfer voltage from the power supply circuit E.

The photosensitive member cleaner CL is disposed on the downstream side of the transfer roller Rt, in the rotation direction of the photosensitive member PR. The photosensitive member cleaner CL supports a recovery path CL4, serving as an example of a developer transport path. The recovery path CL4 extends from the photosensitive member cleaner CL to the developing device G.

A fixing device F is supported above the transfer roller Rt. The fixing device F includes a heating roller Fh, serving as an example of a heating-fixing member, and a pressure roller Fp, serving as an example of a pressure-fixing member. The heating roller Fh and the pressure roller Fp are in contact with each other in a fixing area Q4. The heating roller Fh is rotated by a driving force transmitted from a driving force source (not shown). The heating roller Fh is supplied with power for heating a heater (not shown) from the electric circuit E.

The process unit U2, serving as an example of a toner-image forming unit; the transfer roller Rt; and the fixing device F form an image recording portion U2+Rt+F, which records an image on a sheet S.

A sheet guide F1, serving as an example of a medium guide portion, is formed above the fixing device F. Output rollers R1, serving as an example of a medium output member, is provided to the right of the sheet guide F1. A medium output port Ha is provided to the right of the output rollers R1. The first output tray TRh is provided below the medium output port Ha.

Referring to FIG. 1, a connecting path SH3, serving as an example of a medium transport path, is provided above the fixing device F and to the left of the output rollers R1. The connecting path SH3 extends leftward from the medium output port Ha.

A reversing unit U3, serving as an example of a medium reversing unit, is supported on the left side surface of the printer body U1, above the manual feed tray TR0. A reversing path SH4, serving as an example of a medium transport path, is formed inside the reversing unit U3. An upper end of the reversing path SH4 is connected to a left end of the connecting path SH3. A lower end of the reversing path SH4 joins the paper feed path SH1, at a position on the upstream side of the registration rollers Rr.

A second output path SH6, serving as an example of a medium transport path, is formed in the upper part of the reversing unit U3. The second output path SH6 is connected to the connecting path SH3 at a right end and diverges from the reversing path SH4. A left end of the second output path SH6 is located at a left side surface of the reversing unit U3. A face-up tray TRh1, serving as an example of a second output portion, is supported on the left side surface of the reversing unit U3. Thus, a sheet S passing through the second output path SH6 is output onto the face-up tray TRh1.

Function of Image Forming Apparatus

In the thus-configured printer U according to the first exemplary embodiment, image information sent from the personal computer PC is input to the controller C. The controller C converts the image information to information used for forming a latent image at predetermined timing and outputs the information to the writing circuit DL. The exposure unit ROS emits laser light L according to the signal received by the writing circuit DL. The controller C controls the operation of the operating portion UI, the writing circuit DL, the power supply circuit E, etc.

Referring to FIGS. 1 and 2, the surface of the photosensitive member PR is charged by the charging roller CR, which is supplied with a charging voltage. The surface of the photosensitive member PR charged by the charging roller CR is exposed to and scanned with the laser light L emitted from the exposure unit ROS at the writing position Q1, and an electrostatic latent image is formed. The surface of the photosensitive member PR having the electrostatic latent image successively passes the developing area Q2 and the transfer area Q3.

In the developing area Q2, the photosensitive member PR is opposed to the developing roller Ga. The developing roller Ga rotates with the developer in the developer container V adhered to the surface thereof. The electrostatic latent image on the surface of the photosensitive member PR is developed into a toner image, serving as an example of a visible image, with the toner adhered to the surface of the developing roller Ga. The developer in the developer container V circulates while being stirred by augers Gb and Gc.

As the developer in the developer container V is consumed due to the developing roller Ga developing images, developer is supplied by the toner cartridge TC. That is, the toner in the cartridge TC is transported to a discharge port TC3 according to the amount of developer consumed. The toner discharged from the toner discharge port TC3 is transported to the developer container V by a toner-supply transport member (not shown) in a supply path of the toner supply unit TH1.

The paper feed trays TR1 to TR4 accommodate sheets S, on which images are to be recorded. The sheets S accommodated in any one of the paper feed trays TR1 to TR4 are picked up by the pick-up roller Rp of the paper feed unit K. The sheets S picked up by the pick-up roller Rp are separated into individual sheets S by the separating rollers Rs. The sheet S separated by the separating rollers Rs is fed to the paper feed path SH1. The sheet S in the paper feed path SH1 is transported toward the registration rollers Rr by the transport rollers Ra.

A sheet S fed from the manual feed tray TR0 is transported to the registration rollers Rr through the manual feed path SH2. The sheet S transported to the registration rollers Rr is transported to the transfer area Q3 by the registration rollers Rr, at the same time when the toner image on the surface of the photosensitive member PR is transported to the transfer area Q3.

In the transfer area Q3, the transfer roller Rt supplied with a transfer voltage causes the toner image on the surface of the photosensitive member PR to be transferred to the sheet S passing through the transfer area Q3.

Referring to FIG. 2, the photosensitive member PR passing the transfer area Q3 is cleaned by the photosensitive member cleaner CL (toner deposited on the surface of the photosensitive member PR is removed). The toner removed by the photosensitive member cleaner CL is returned to the developer container V through the recovery path CL4. The developer recovered by the photosensitive member cleaner CL is reused by the developing device G.

After the photosensitive member cleaner CL has cleaned the surface of the photosensitive member PR, the photosensitive member PR is charged again by the charging roller CR.

The sheet S having the toner image transferred thereto in the transfer area Q3, but not yet fixed, is transported to the fixing area Q4 of the fixing device F.

In the fixing area Q4, the sheet S is nipped between the heating roller Fh and the pressure roller Fp, and the toner image is heated and fixed.

The sheet S having the toner image fixed thereto in the fixing device F is transported to the output rollers R1 by the guide of the sheet guide F1. When the sheet S is to be output onto the first output tray TRh, the sheet S sent to the output rollers R1 is output onto the first output tray TRh from the medium output port Ha.

In two-sided printing, once a trailing end, in a transport direction, of a sheet S having an image recorded on a first side thereof passes through the sheet guide F1, the output rollers R1 is rotated in the opposite direction. As a result, the sheet S is transported to the reversing path SH4 via the connecting path SH3. The sheet S transported along the reversing path SH4 is transported to the registration rollers Rr in a reversed state. Then, the sheet S is transported again from the registration rollers Rr to the transfer area Q3, where an image is recorded on a second surface thereof.

When a sheet S is output onto the face-up tray TRh1, the sheet S transported via the connecting path SH3 due to the reverse rotation of the output rollers R1 enters the second output path SH6. Then, the sheet S transported along the second output path SH6 is output onto the face-up tray TRh1.

Toner Cartridge

Figure 3:
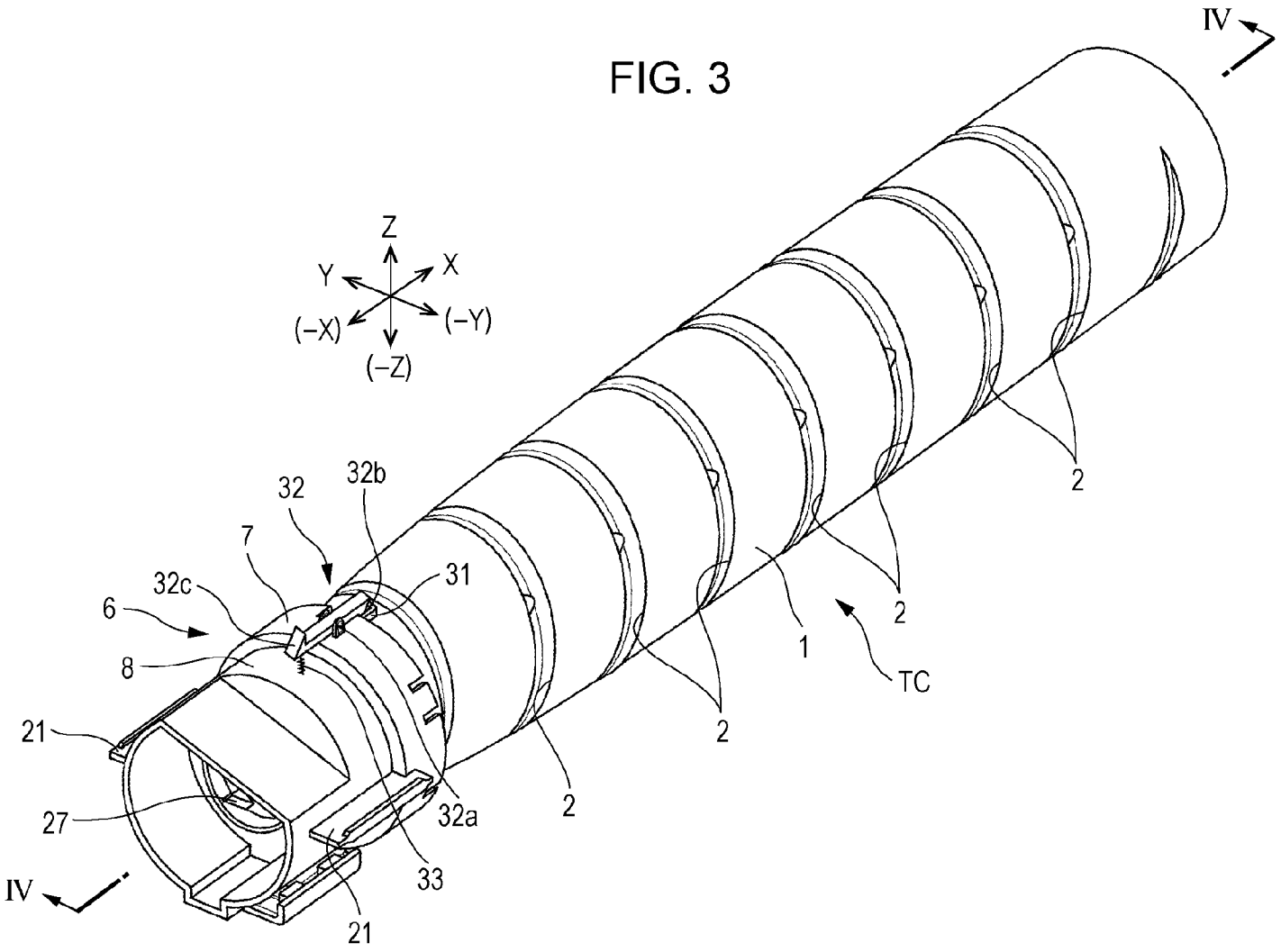
FIG. 3 is a perspective view of a toner cartridge according to the first exemplary embodiment.

FIG. 3 is a perspective view of the toner cartridge TC according to the first exemplary embodiment.

Figure 4:
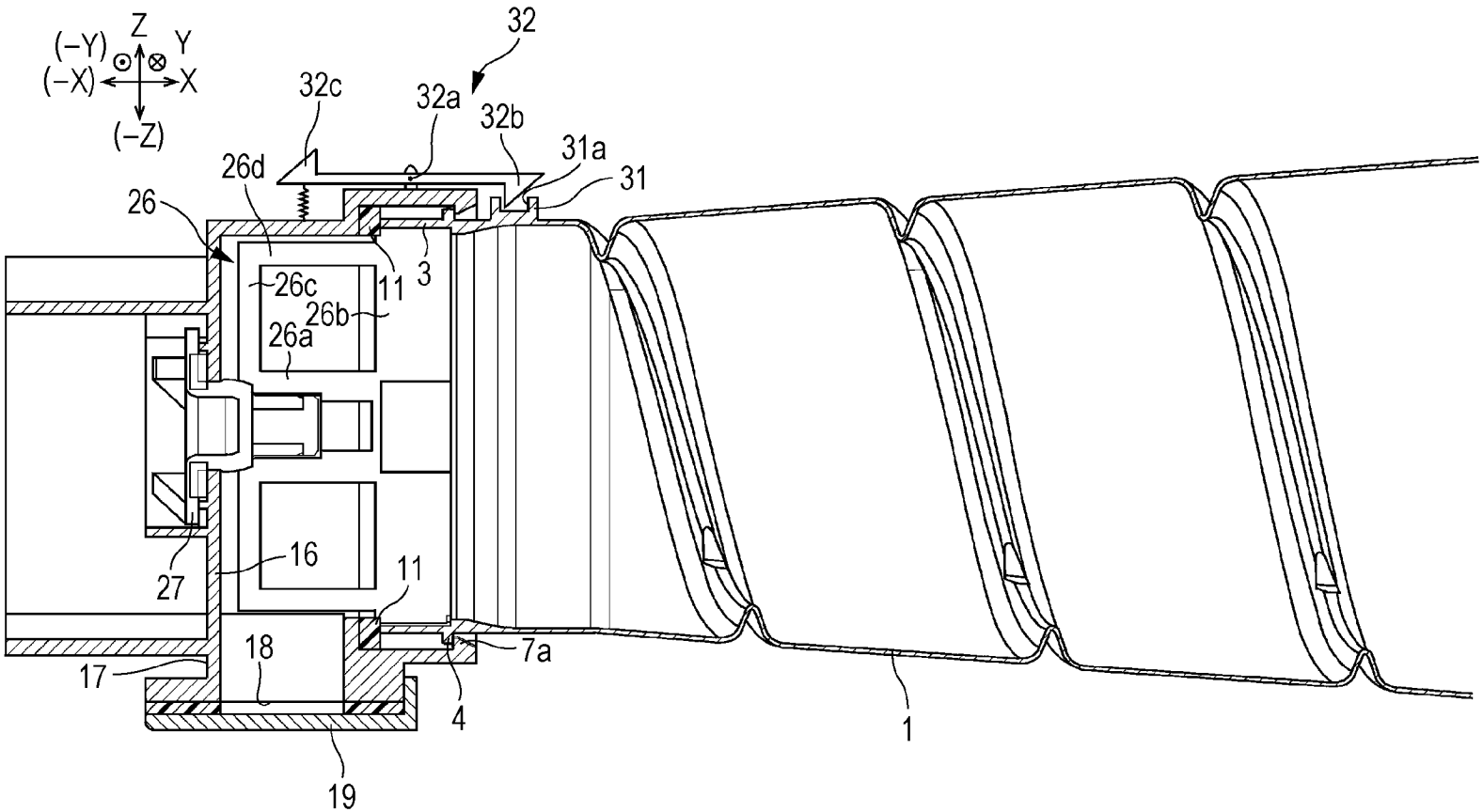
FIG. 4 is a sectional view taken along line IV-IV in FIG. 3.

FIG. 4 is a sectional view taken along line IV-IV in FIG. 3.

Figure 5:
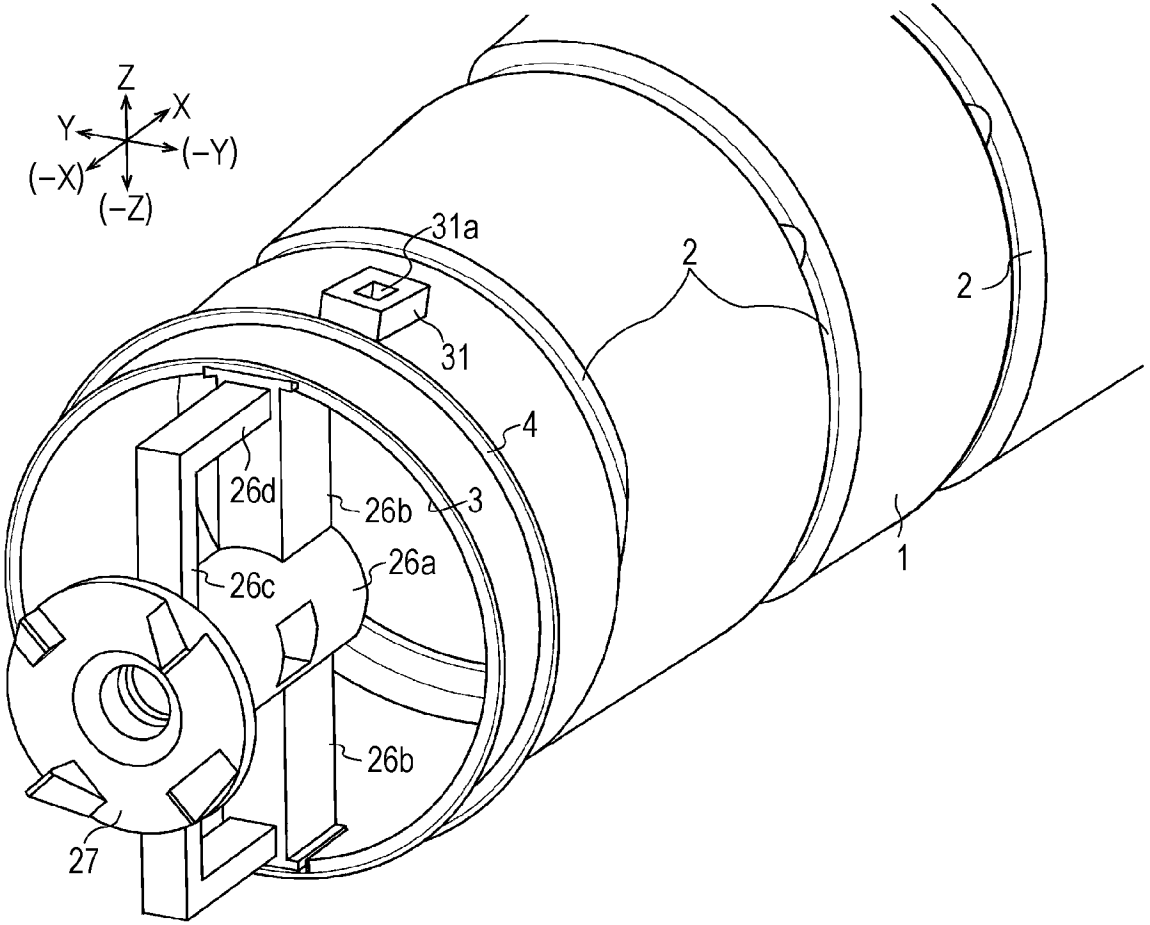
FIG. 5 is a view similar to FIG. 3, but without a flange.

FIG. 5 is a view similar to FIG. 3, but without a flange.

Referring to FIGS. 3 to 5, the toner cartridge TC according to the first exemplary embodiment includes a bottle 1, serving as an example of a containing portion. The bottle 1 has a cylindrical shape extending in the front-rear direction and is configured to contain developer. The bottle 1 has a spiral groove 2, serving as an example of a transporting portion, in the wall thereof. Referring to FIGS. 4 and 5, the bottle 1 has an opening 3 in the rear end. A ring-shaped stopper portion 4 extending radially outward is provided at the front of the opening 3.

A flange 6, serving as an example of a discharge portion, is supported at the rear end of the bottle 1. The flange 6 has a cylindrical shape. The flange 6 includes a large-diameter portion 7 on the front side and a small-diameter portion 8 on the rear side thereof.

The inside diameter of the large-diameter portion 7 is larger than the outside diameter of the rear end of the bottle 1. The large-diameter portion 7 has a stopper portion 7*a* extending radially inward, at the front end.

The inside diameter of the small-diameter portion 8 is smaller than the outside diameter of the rear end of the bottle 1. The small-diameter portion 8 supports a sealing member 11, which is an example of a sealing part, at the front end face thereof. Hence, the rear end of the bottle 1 is inserted into the large-diameter portion 7, and, as shown in FIG. 4, the stopper portion 4 of the bottle 1 is fitted to the stopper portion 7*a* of the large-diameter portion 7. In this manner, the bottle 1 is rotatably supported by the flange 6. The rear end of the bottle 1 is urged against the sealing member 11, so that the developer in the bottle 1 does not leak out.

Furthermore, a plate-shaped wall 16, which extends in the top-bottom and left-right directions, is provided in the middle of the small-diameter portion 8 in the front-rear direction. A discharge path 17 extending downward is provided at the bottom of the small-diameter portion 8. The discharge path 17 has a discharge port 18, serving as an example of a flow out port, at the lower end.

A shutter 19, serving as an example of an opening/closing member, is supported at the bottom of the discharge path 17 so as to be movable in the front-rear direction.

Referring to FIG. 3, insertion guides 21, serving as an example of a guided portion, are formed on the outer circumferential surface of the small-diameter portion 8. The insertion guides 21 are guided by guiding portions (not shown) provided on the printer body U1, serving as an example of an image forming apparatus body, when the toner cartridge TC is attached.

Referring to FIGS. 4 and 5, a fin 26, serving as an example of a levelling member, is provided inside the small-diameter portion 8, in front of the wall 16. The fin 26 has a shaft 26*a* extending in the front-rear direction. Support arms 26*b*, serving as an example of a levelling part and a supported part and extending radially outward, are provided at the front end of the shaft 26*a*. The support arms 26*b* are in contact with and supported by the inner circumferential surface of the rear end of the bottle 1. That is, the fin 26 and the bottle 1 are integrally rotatable relative to the flange 6.

First levelling parts 26*c* extending radially outward are provided at the rear part of the shaft 26*a*. Second levelling parts 26*d* extending in the front-rear direction are formed between the radially outer ends of the first levelling parts 26*c* and the support arms 26*b*.

A coupling 27, serving as an example of a driven-force transmitting member, is supported at the rear end of the shaft 26*a*. The coupling 27 is rotatably supported by the wall 16.

Figure 6A:
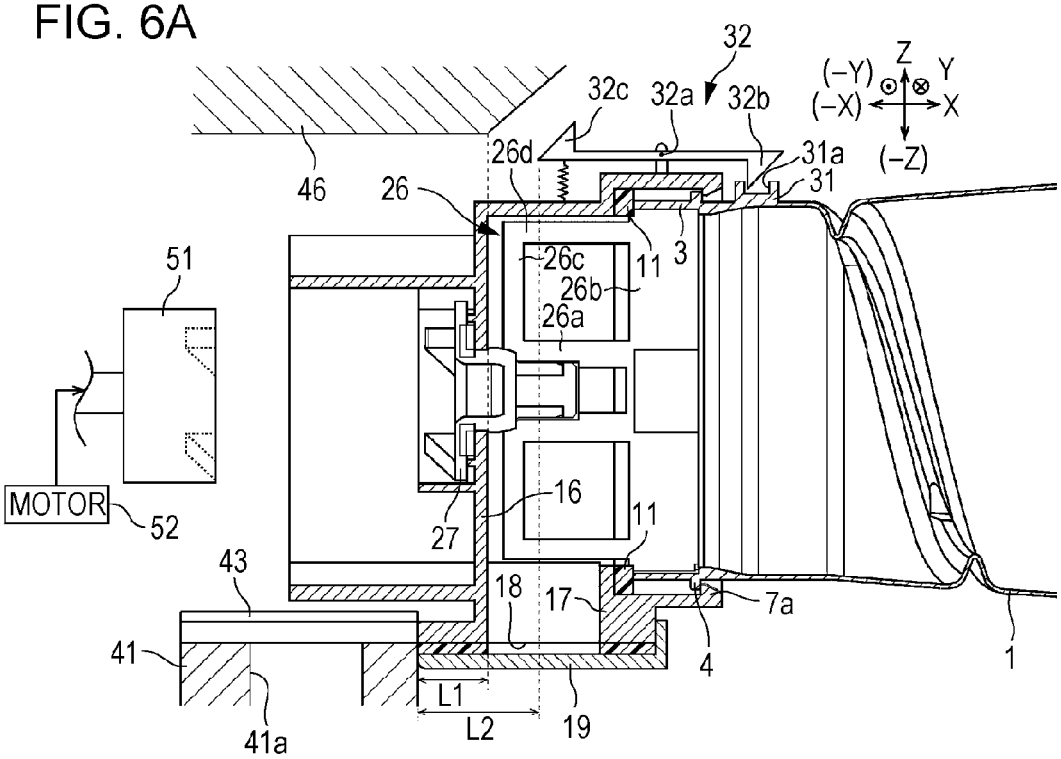
FIGS. 6A and 6B show a restricting member and a releasing member according to the first exemplary embodiment, in a state in which the toner cartridge is being inserted and in a state in which the toner cartridge has been inserted, respectively.
Figure 6B:
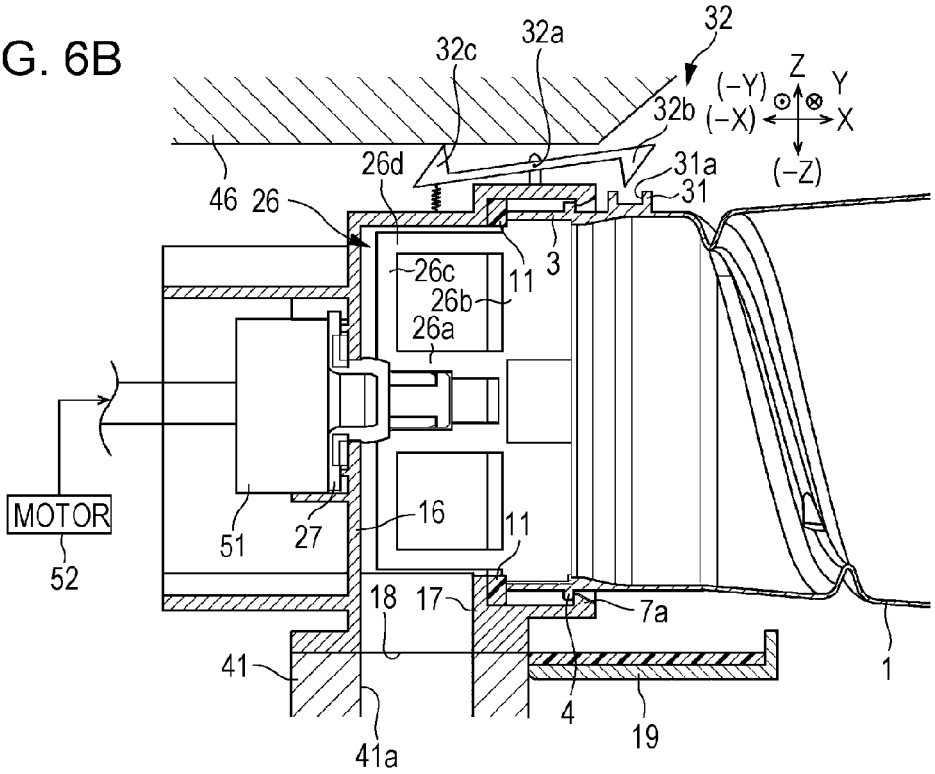

FIGS. 6A and 6B show a restricting member and a releasing member according to the first exemplary embodiment, in a state in which the toner cartridge is being inserted and in a state in which the toner cartridge has been inserted, respectively.

Referring to FIGS. 3 and 4, the bottle 1 has a locked part 31, serving as an example of a restricted portion, on the outer surface thereof, at a position in front of the stopper portion 4. The locked part 31 is provided with a recess 31*a*.

Furthermore, a lock member 32, serving as an example of a restricting member, is supported on the outer surface of the flange 6. The lock member 32 has a rod shape extending in the front-rear direction. The lock member 32 is supported in the middle in the front-rear direction, so as to be pivotable about a pivot shaft 32*a*. The lock member 32 according to the first exemplary embodiment is supported so as to be movable between a restricting position, shown in FIG. 6A, and a releasing position, shown in FIG. 6B.

The lock member 32 has a first hook 32*b* at the front end, corresponding to the recess 31*a*. Referring to FIGS. 6A and 6B, when the lock member 32 is moved to the restricting position, the first hook 32*b* is engaged with the recess 31*a*, and when the lock member 32 is moved to the releasing position, the first hook 32*b* is disengaged from the recess 31*a*.

Furthermore, the lock member 32 has a second hook 32*c* projecting upward, at the rear end.

A spring 33, serving as an example of a moving member, is supported at the rear end of the lock member 32. The spring 33 applies a force to the lock member 32 to move the lock member 32 to the restricting position.

Figure 7A:
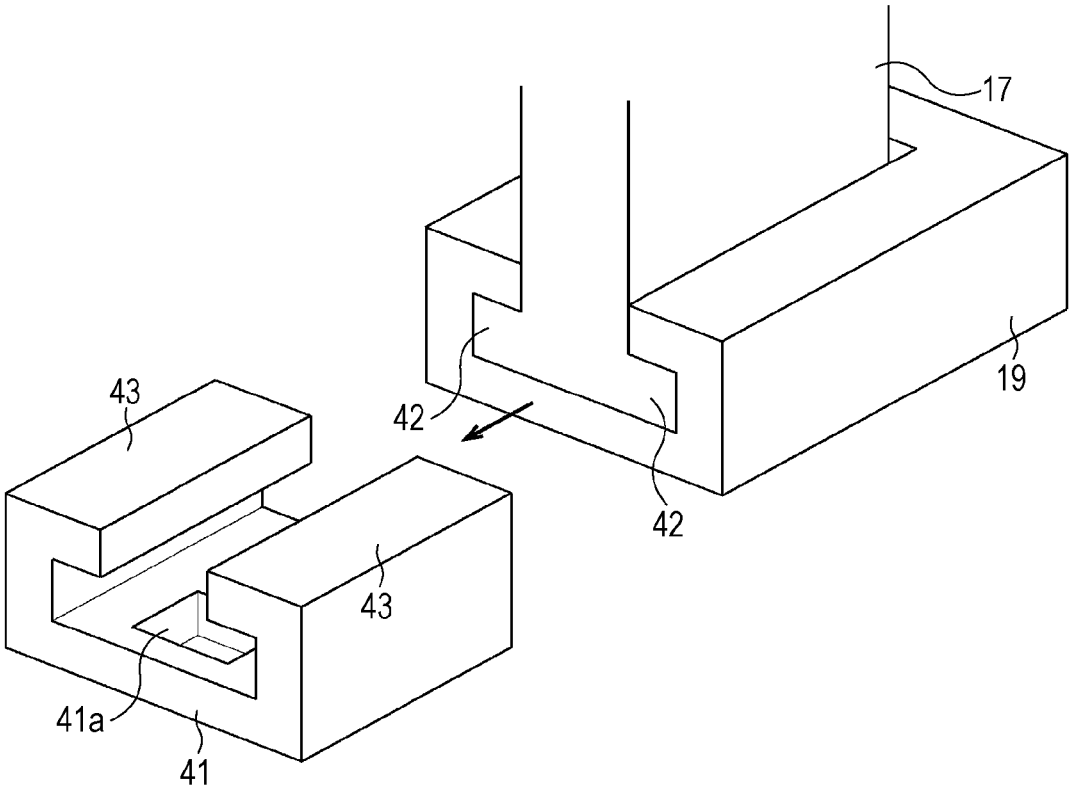
FIGS. 7A and 7B show a positioning member according to the first exemplary embodiment, in a state in which the toner cartridge is removed and in a state in which the toner cartridge is attached, respectively.
Figure 7B:
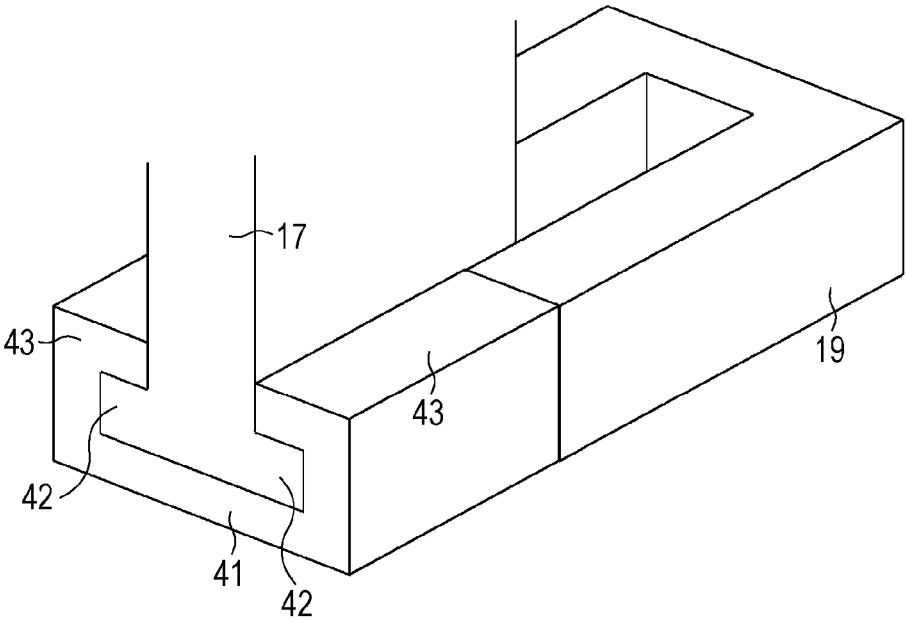

FIGS. 7A and 7B show a positioning member according to the first exemplary embodiment, in a state in which the toner cartridge is removed and in a state in which the toner cartridge is attached, respectively.

Referring to FIGS. 6A, 6B, 7A, and 7B, in the printer body U1 according to the first exemplary embodiment, the toner supply unit TH1, to which the toner cartridge TC is to be attached, has a positioning member 41. The positioning member 41 has an inlet port 41*a* that communicates with the discharge port 18. The positioning member 41 has a guide support portion 43, serving as an example of a positioning member body, corresponding to a guiding portion 42 on the flange 6 for guiding the shutter 19. The guide support portion 43 is shaped so as to wrap around the guiding portion 42 from outside.

Referring to FIGS. 6A and 6B, an unlock portion 46, serving as an example of a releasing member, is provided above the positioning member 41. When the toner cartridge TC is attached to the printer body U1, the unlock portion 46 comes into contact with the second hook 32*c* of the lock member 32, moving the lock member 32 to the releasing position. In the first exemplary embodiment, the distance L1 between the front end of the guide support portion 43 and the front end of the unlock portion 46 is smaller than the distance L2 between the rear end of the guiding portion 42 and the rear end of the second hook 32*c*. That is, the respective parts are arranged such that, when the toner cartridge TC is attached to the printer body U1, the unlock portion 46 comes into contact with the second hook 32*c* of the lock member 32 after the guide support portion 43 positions the guiding portion 42.

Referring to FIGS. 6A and 6B, a coupling 51, serving as an example of a driving-force transmitting member and corresponding to the coupling 27, is provided between the positioning member 41 and the unlock portion 46. When the toner cartridge TC is attached to the printer body U1, the coupling 51 on the printer body U1 is coupled to the coupling 27 on the toner cartridge TC. The coupling 51 receives a driving force from a motor 52, serving as an example of a driving force source.

Advantages of First Exemplary Embodiment

In the thus-configured printer U according to the first exemplary embodiment, in a state in which the toner cartridge TC is attached to the printer body U1, when a driving force is transmitted from the motor 52 in response to the consumption of the toner, the fin 26 and the bottle 1 rotate via the couplings 27 and 51. As the bottle 1 rotates, the developer is transported rearward along the spiral groove 2. Hence, the provision of a transport member rotating inside the bottle is unnecessary, making it possible to reduce the manufacturing cost of the toner cartridge TC.

The developer transported rearward with the rotation of the bottle 1 is supplied to the inlet port 41*a* in the toner supply unit TH1 through the discharge port 18. The fin 26 rotates with the bottle 1, loosening the toner packed near the discharge port 18. Thus, compared with a configuration without the fin 26, clogging of the discharge port 18 with packed developer is suppressed.

Furthermore, in the toner cartridge TC according to the first exemplary embodiment, when the toner cartridge TC is removed, the spring 33 moves the lock member 32 to the restricting position, and the lock member 32 enters the recess 31*a* in the locked part 31. As a result, rotation of the bottle 1 is restricted. If the flange 6 having the discharge port 18 and the shutter 19 is rotatable relative to the bottle 1, the flange 6 may rotate when the toner cartridge TC is handled by gripping the bottle 1, scattering toner deposited on the vicinity of the shutter 19, or staining operator's clothes. Thus, ease of handling of the toner cartridge TC is low.

In particular, in the first exemplary embodiment, the toner cartridge TC is attached to the printer body U1 such that the flange 6 is located on the front side, i.e., on the farther side of the printer body U1, in the attaching direction. Hence, the operator holds the front end of the bottle 1, not the flange 6, when attaching or removing the toner cartridge TC. When the toner cartridge TC is attached to the printer body U1, if the flange 6 is freely rotated relative to the bottle 1 by a very small force, it is difficult to align an opening in a toner-cartridge attaching portion with the flange 6. Hence, it is necessary to reattach the toner cartridge TC or to attach the toner cartridge TC while checking the angle of the flange 6, which decreases ease of handling.

However, if the torque between the bottle 1 and the flange 6 is increased to improve ease of handling, the driving force needed to drive the bottle 1 when toner is supplied from the toner cartridge TC increases. Thus, in a state in which the toner cartridge TC is attached to the printer body U1, the torque between the bottle 1 and the flange 6 is preferably low.

In contrast, in the first exemplary embodiment, in a state in which the toner cartridge TC is removed from the printer body U1, the lock member 32 restricts free rotation of the bottle 1 and flange 6. Hence, compared with a case where free rotation of the bottle 1 and flange 6 is allowed, ease of handling is high.

Furthermore, in the first exemplary embodiment, only by attaching the toner cartridge TC to the printer body U1, the lock member 32 comes into contact with the unlock portion 46 and releases the rotation restriction, i.e., rotation lock. Hence, after the toner cartridge TC is attached to the printer body U1, the bottle 1 becomes rotatable and possible to transport the developer accommodated in the bottle 1.

Furthermore, in the first exemplary embodiment, the relationship between the distances L1 and L2 is set as L1≤L2. If the relationship between the distances L1 and L2 is set as L1>L2, rotation lock is released before the guide support portion 43 positions the guiding portion 42. As a result, the flange 6 becomes freely rotatable relative to the bottle 1, and the guiding portion 42 may be displaced from the guide support portion 43. However, in the first exemplary embodiment, because the relationship between the distances L1 and L2 is set as L1≤L2, rotation lock is released after the guide support portion 43 positions the guiding portion 42. Hence, misregistration between the guiding portion 42 of the flange 6 and the guide support portion 43 is prevented, improving ease of handling.

Second Exemplary Embodiment

Figure 8:
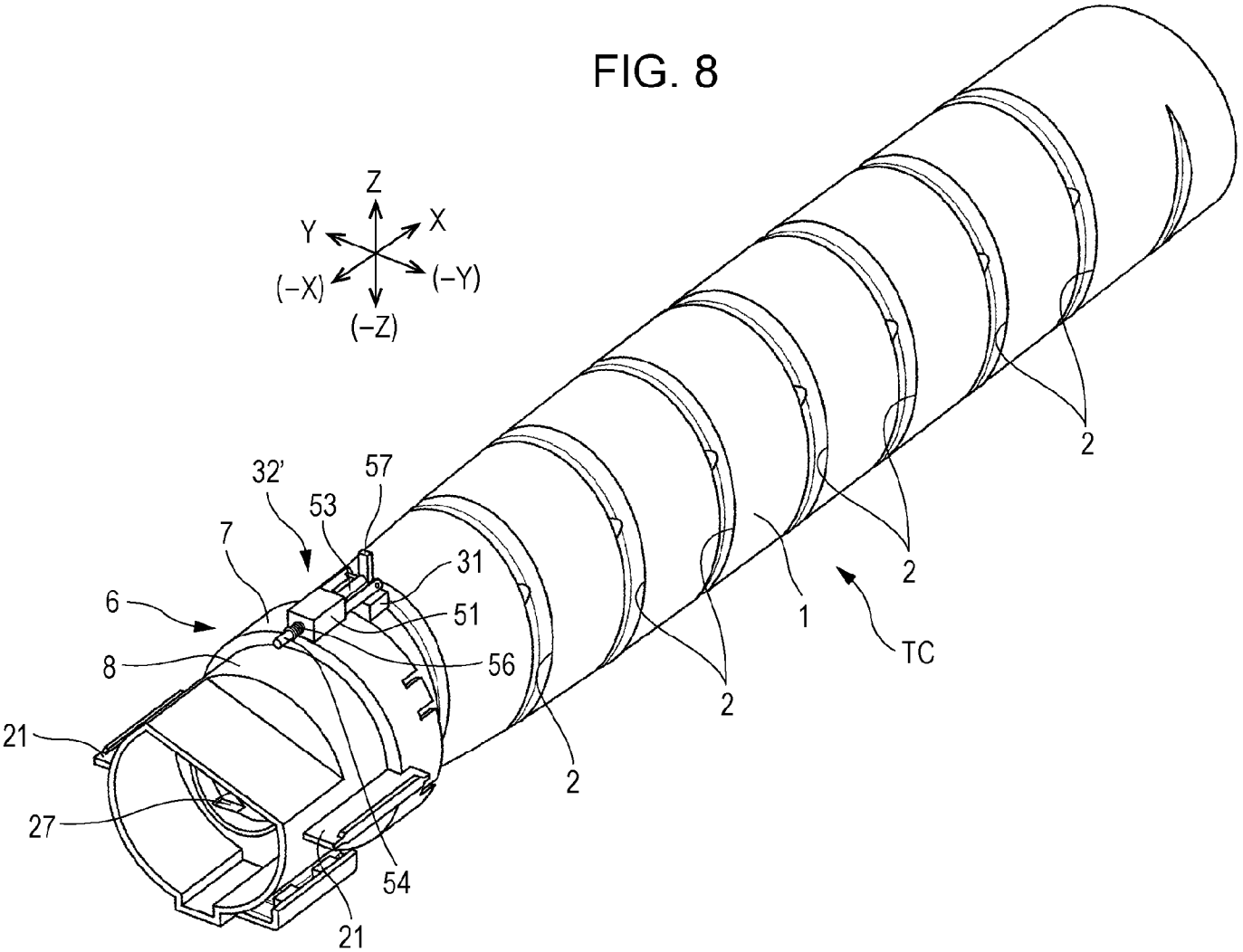
FIG. 8 is a perspective view of a toner cartridge according to a second exemplary embodiment, similarly to FIG. 3 showing the first exemplary embodiment.

FIG. 8 is a perspective view of a toner cartridge according to a second exemplary embodiment, similarly to FIG. 3 showing the first exemplary embodiment.

Figure 9A:
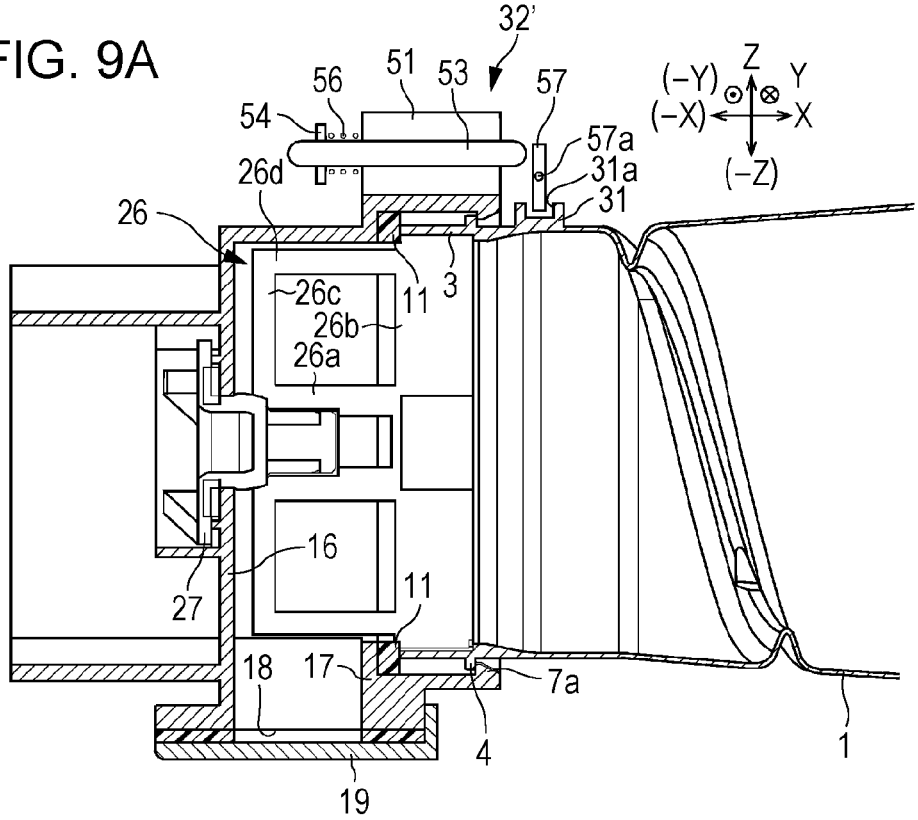
FIGS. 9A and 9B show the toner cartridge according to the second exemplary embodiment, in a state in which the toner cartridge is removed and in a state in which the toner cartridge is attached to a printer body, respectively.
Figure 9B:
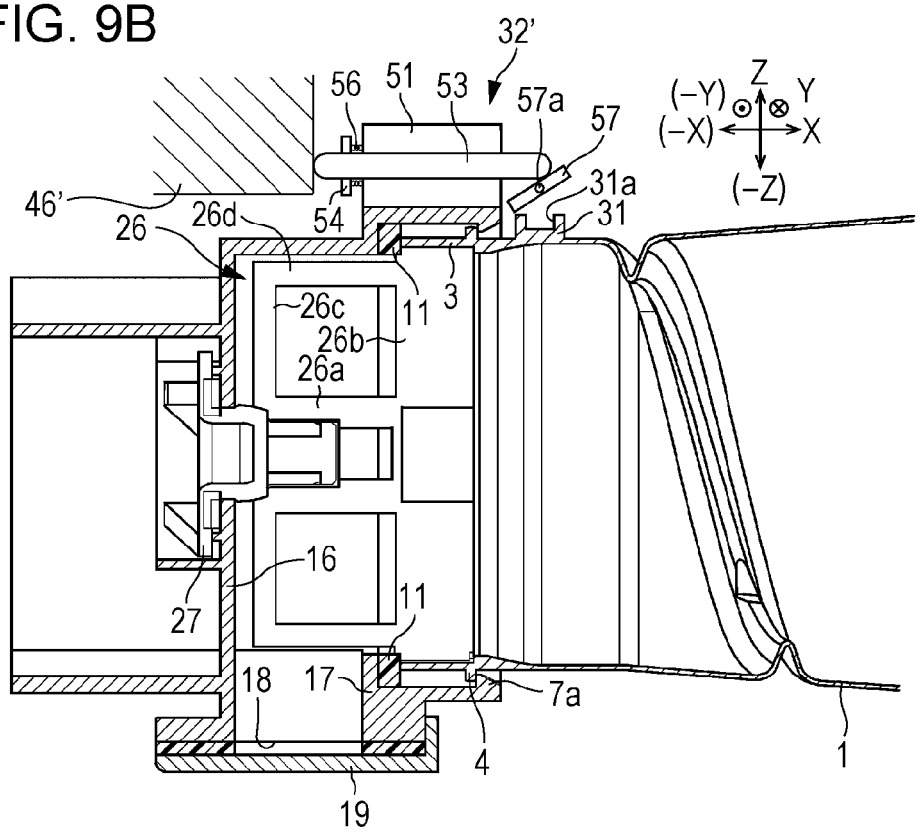

FIGS. 9A and 9B show the toner cartridge according to the second exemplary embodiment, in a state in which the toner cartridge is removed and in a state in which the toner cartridge is attached to a printer body, respectively.

The second exemplary embodiment of the present invention will be described below, wherein the components corresponding to those of the first exemplary embodiment will be denoted by the same reference numerals and will not be described in detail.

The second exemplary embodiment is the same as the first exemplary embodiment, except for the following configuration.

Referring to FIG. 8, the toner cartridge TC according to the second exemplary embodiment has a lock member 32' and an unlock portion 46', instead of the lock member 32 and the unlock portion 46.

The lock member 32' according to the second exemplary embodiment has a shaft support 51, serving as an example of a shaft support portion and is supported on the outer circumference of the large-diameter portion 7. The shaft support 51 has a pair of right and left arms 52 extending forward. The shaft support 51 supports a shaft 53, serving as an example of a shaft member and extending in the front-rear direction so as to be movable in the front-rear direction. The shaft 53 supports a ring 54, serving as an example of a ring-shaped member, is supported at the rear part thereof. Between the ring 54 and the shaft support 51 is a spring 56, serving as an example of a moving member. The spring 56 according to the second exemplary embodiment exerts a force that moves the shaft 53 forward via the ring 54. A lock plate 57, serving as an example of a restricting member body, is rotatably supported at the front ends of the arms 52. The lock plate 57 is provided so as to correspond to the recess 31*a* in the locked part 31. An axis of rotation 57*a* of the lock plate 57 according to the second exemplary embodiment is located below (i.e., closer to the surface of the bottle 1 than) the shaft 53.

Furthermore, the unlock portion 46' according to the second exemplary embodiment is provided at a position where it comes into contact with the rear end of the shaft 53 and moves the shaft 53 forward when the toner cartridge TC is attached to the printer body U1. Also in the second exemplary embodiment, similarly to the first exemplary embodiment, the unlock portion 46' is located at a position satisfying the relationship between the distances L1 and L2, L1≤L2.

In the thus-configured printer U according to the second exemplary embodiment, similarly to the first exemplary embodiment, free rotation of the bottle 1 and the flange 6 is locked before the toner cartridge TC is attached to the printer body U1, and rotation of the bottle 1 is allowed after the toner cartridge TC is attached to the printer body U1.

Third Exemplary Embodiment

Figure 10:
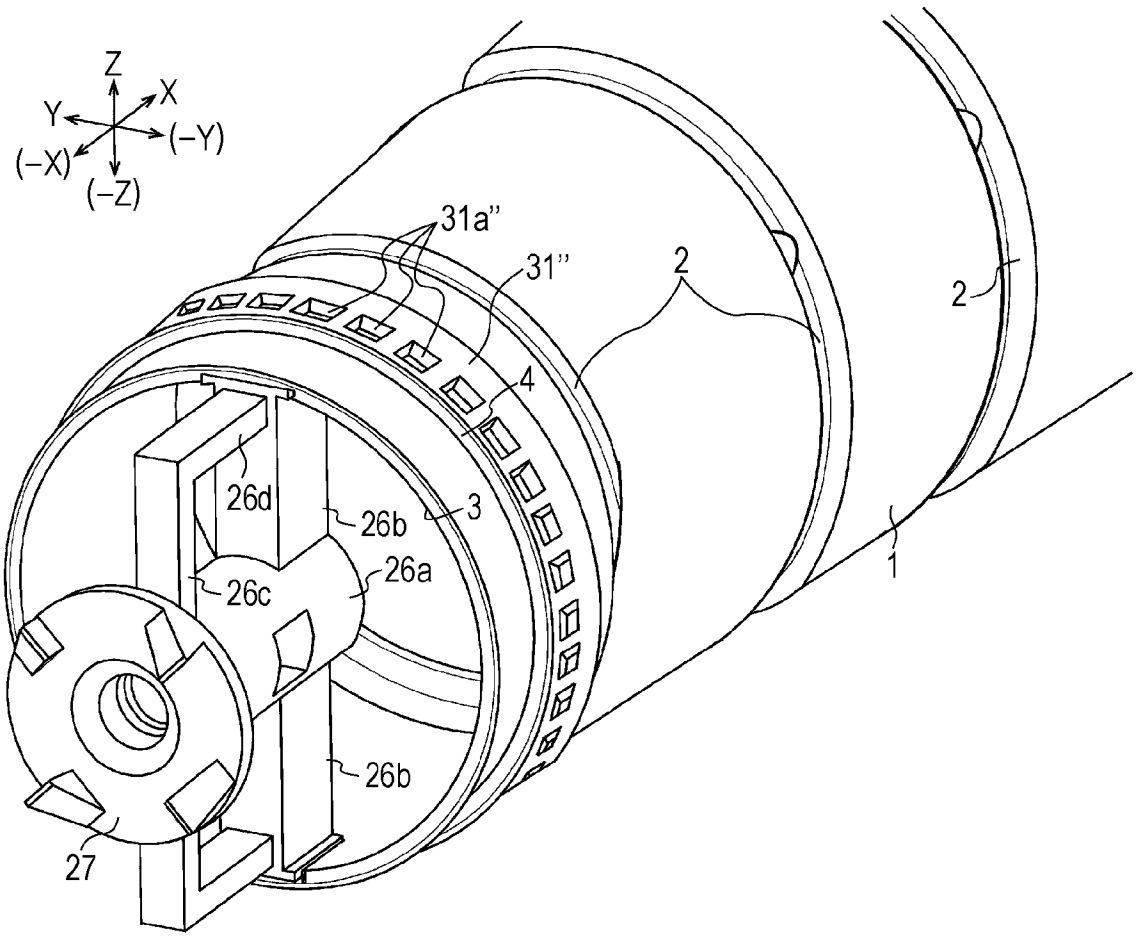
FIG. 10 shows a toner cartridge according to a third exemplary embodiment, similarly to FIG. 5 showing the first exemplary embodiment.

FIG. 10 shows a toner cartridge according to a third exemplary embodiment, similarly to FIG. 5 showing the first exemplary embodiment.

The third exemplary embodiment of the present invention will be described below, wherein the components corresponding to those of the first exemplary embodiment will be denoted by the same reference numerals and will not be described in detail.

The third exemplary embodiment is the same as the first exemplary embodiment, except for the following configuration.

Referring to FIG. 10, the toner cartridge TC according to the third exemplary embodiment has a locked part 31" different from the locked part 31 according to the first exemplary embodiment. The locked part 31" according to the third exemplary embodiment is formed in a ring shape extending in the circumferential direction of the bottle 1. The locked part 31" has recesses 31*a*" arranged at intervals in the circumferential direction.

In the thus-configured printer U according to the third exemplary embodiment, similarly to the first and second exemplary embodiments, free rotation of the bottle 1 and the flange 6 is locked before the toner cartridge TC is attached to the printer body U1, and rotation of the bottle 1 is allowed after the toner cartridge TC is attached to the printer body U1.

Furthermore, in the configurations according to the first and second exemplary embodiments, when the toner cartridge TC is to be removed, the rotational position (phase) of the locked part 31 needs to be matched with the position of the lock member 32. However, in the third exemplary embodiment, the rotation is locked by the lock member 32, without needing to match the rotational positions.

Modification

Although exemplary embodiments of the present invention have been described in detail above, the present invention is not limited to the above-described exemplary embodiments, and it may be variously modified within a scope of the present invention described in claims. Modifications (H01) to (H07) of the present invention will be described below.

(H01) Although the above-described exemplary embodiments show a printer, serving as an example of an image forming apparatus, the present invention may be applied to other image forming apparatuses, such as copiers, facsimile machines, etc.

(H02) Although the above-described exemplary embodiments show a configuration in which the flange 6 and the positioning member 41 are provided on the front side of the toner cartridge TC (i.e., on the farther side of the printer body U1) in the attaching direction, the configuration is not limited thereto. For example, a configuration in which the flange 6 and the positioning member 41 are provided on the rear side (i.e., on the nearer side of the printer body U1) in the attaching direction is also possible.

(H03) Although it is desirable that the relationship between the distances L1 and L2 be set as L1≤L2 in the above-described exemplary embodiments, the relationship between the distances L1 and L2 may be set as L1>L2 when the another parts, such as the insertion guides 21, are used for positioning.

(H04) In the first and second exemplary embodiments, the rotational positions of the locked part 31 and lock member 32 may be matched by using a sensor for detecting the rotational position of the bottle 1, and stopping the bottle 1 such that the locked part 31 and the lock member 32 are aligned when an image forming process is completed, or by configuring such that the bottle 1 is rotated only by an integer number.

(H05) Although it is desirable to provide the fin 26 in the above-described exemplary embodiments, the fin 26 may be omitted. Furthermore, although the fin 26 has two support arms 26*b*, the number of the support arms 26*b* is not limited to two, but may be three or more.

(H06) Although the above-described exemplary embodiments have shown a configuration in which the couplings 27 and 51 for driving the bottle 1 are provided at the rear end, the configuration is not limited thereto. For example, a coupling shape may be formed at the front end of the bottle 1, or a gear may be formed on the outer circumferential surface of the bottle 1, to rotate the bottle 1.

(H07) Although the above-described exemplary embodiments have shown a configuration in which the unlock portions 46 and 46' directly come into contact with the restricting members 32 and 32' to move the restricting members 32 and 32', the configuration is not limited thereto. For example, magnets may be used as the unlock portions, and the restricting members 32 and 32' may be moved by a magnetic force, not by direct contact.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a developer container including a containing portion configured to contain developer and configured to rotate when a driving force is transmitted to the containing portion from an image forming apparatus body, a discharge portion configured to rotatably support the containing portion and has a discharge port through which the developer is configured to be discharged, and a restricting member provided at the discharge portion and configured to move between a restricting position where the restricting member is configured to restrict a rotation of the containing portion and a releasing position where the restricting member is configured to release the restriction of the rotation of the containing portion, the developer container being removably attached to the image forming apparatus body; and a releasing member supported on the image forming apparatus body and configured to move the restricting member to the releasing position when the developer container is attached to the image forming apparatus body, wherein the restricting member restricts the rotation of the containing portion with respect to the discharge portion when the developer container is not attached to the image forming apparatus body.

2. The image forming apparatus according to claim 1, wherein the restricting member is configured to move away from the releasing member to the restricting position in response to the developer container being removed from the image forming apparatus body.

3. The image forming apparatus according to claim 1, wherein the restricting member is provided at a front end of the developer container in a direction in which is the developer container is attached to the image forming apparatus body; and wherein the releasing member is provided on a farther side of the image forming apparatus body, in the direction in which the developer container is attached to the image forming apparatus body.

4. The image forming apparatus according to claim 2, wherein the restricting member is provided at a front end of the developer container in a direction in which is the developer container is attached to the image forming apparatus body; and wherein the releasing member is provided on a farther side of the image forming apparatus body, in the direction in which the developer container is attached to the image forming apparatus body.

5. The image forming apparatus according to claim 1, further comprising a positioning member that is provided on the image forming apparatus body and includes an inlet port configured to be connected to the discharge port, the positioning member configured to contact the discharge portion to position the discharge portion when the developer container is attached to the image forming apparatus body, wherein, in response to the developer container being attached to the image forming apparatus body, the releasing member is configured to move the restricting member to the releasing position after the positioning member positions the discharge portion.

6. The image forming apparatus according to claim 1, further comprising:

a restricted portion provided on the containing portion and configured to contact the restricting member for restricting rotation when the restricting member moves to the restricting position, and the restricted portion is disposed in a direction in which the containing portion rotates.

7. A developer container removably supported by an image forming apparatus body, the developer container comprising:

a containing portion configured to contain developer and configured to be rotated when a driving force is transmitted to the containing portion from the image forming apparatus body;

a discharge portion configured to rotatably support the containing portion and includes a discharge port through which the developer is discharged; and a restricting member provided at the discharge portion and configured to be movable between a restricting position where the restricting member is configured to restrict a rotation of the containing portion and a releasing position where the restricting member is configured to release the restriction of the rotation of the containing portion, the restricting member configured to move to the releasing position in response to the container being located at an attaching position where the container is to be attached to the image forming apparatus body, wherein the restricting member restricts the rotation of the containing portion with respect to the discharge portion when the developer container is not attached to the image forming apparatus body.

8. The image forming apparatus according to claim 1, wherein the restricting member is configured to move in a direction perpendicular to an axial direction of the containing portion.

9. The image forming apparatus according to claim 1, wherein the restricting member is configured to move toward the releasing member to the releasing position in response to the developer container being inserted into the image forming apparatus body.

10. The developer container according to claim 7, wherein the restricting member is configured to move in a direction perpendicular to an axial direction of the containing portion.

11. The developer container according to claim 7, wherein the restricting member is configured to move toward the releasing member to the releasing position in response to the developer container being inserted into the image forming apparatus body.

* * * * *